US006240939B1

(12) United States Patent
McGee

(10) Patent No.: US 6,240,939 B1
(45) Date of Patent: Jun. 5, 2001

(54) WINDBREAK

(76) Inventor: Charles P. McGee, 55, Wyccliff Crescent, Kingston, ON (CA), K7K 5Z2

( * ) Notice: Subject to any disclaimer, the term of this patent is extended or adjusted under 35 U.S.C. 154(b) by 0 days.

(21) Appl. No.: 09/273,501

(22) Filed: Mar. 22, 1999

(51) Int. Cl.[7] ..... E04H 15/44

(52) U.S. Cl. ..... 135/143; 135/87; 135/118; 135/901; 160/351; 160/352

(58) Field of Search ..... 160/351, 352, 160/377, 84.07; 135/100, 121, 128, 143, 151, 153, 118, 901, 87

(56) References Cited

U.S. PATENT DOCUMENTS

| | | | | |
|---|---|---|---|---|
| 1,107,871 | * | 8/1914 | Alkire et al. . | |
| 1,800,369 | * | 4/1931 | Waterhouse . | |
| 2,466,496 | * | 4/1949 | Smith . | |
| 2,619,101 | * | 11/1952 | McGerry et al. . | |
| 2,889,838 | * | 6/1959 | Aviezer et al. . | |
| 3,174,493 | * | 3/1965 | Gruenberg . | |
| 3,480,023 | * | 11/1969 | McConnell et al. . | |
| 3,890,989 | | 6/1975 | Kuxhouse . | |
| 3,957,069 | * | 5/1976 | Denaro . | |
| 4,069,833 | | 1/1978 | Johansson . | |
| 4,407,319 | | 10/1983 | Schultz . | |
| 4,438,940 | | 3/1984 | Hunt . | |
| 4,685,484 | | 8/1987 | Moneta . | |
| 4,782,846 | * | 11/1988 | Ting | 135/120 |
| 4,870,984 | | 10/1989 | Roth . | |
| 4,966,181 | * | 10/1990 | Liberman et al. | 135/87 |
| 4,971,089 | | 11/1990 | Braman . | |
| 5,059,463 | | 10/1991 | Peters . | |
| 5,154,473 | | 10/1992 | Joranco . | |
| 5,368,057 | | 11/1994 | Lubkeman . | |
| 5,379,786 | | 1/1995 | Lynam . | |
| 5,502,929 | | 4/1996 | Daniels . | |
| 5,505,265 | * | 4/1996 | O'Neil . | |
| 5,730,666 | | 3/1998 | Hudson . | |
| 5,823,217 | | 10/1998 | Rice . | |

* cited by examiner

*Primary Examiner*—Robert Canfield
(74) *Attorney, Agent, or Firm*—Richard J. Hicks

(57) ABSTRACT

A portable and foldable shelter for use by ice fishermen and other outdoorsmen is described. A tripod of pole members, hingedly interconnected at one end, is covered with a canvas or plastics cover. A hinged tang is provided on the central pole member which can be secured to the ice and about which the erected shelter can be rotated to keep the open side thereof directly downwind in the event of a wind shift.

7 Claims, 2 Drawing Sheets

WINDBREAK

FIELD OF INVENTION

This invention relates to a portable windbreak for use, for example, by ice fishermen and the like.

BACKGROUND OF INVENTION

Portable, folding, screens and windbreaks are, of course, well known in the art. Attention is directed, for example, to U.S. Pat. Nos. 5,730,666; 4,971,089 and 4,870,984 which all describe some form of folding, portable sun and/or windscreen which can be simply erected or stowed. Such devices usually incorporate a collapsible metal rod frame over which a canvas or plastics material cover can be attached. These devices are, however, relatively cumbersome and not particularly well adapted for single handed erection nor are they very stable in strong wind conditions. There is a need, therefore, for an improved portable windbreak which can be quickly and easily erected by one person and which will be effective and stable when mounted on an ice surface for use in strong winds such as often pertain during such activities as ice fishing or judging skating or skiing events and the like.

OBJECT OF INVENTION

It is an object of the present invention to provide a portable and collapsible shelter which can be erected by one person and which can be used in strong winds on an ice surface.

BRIEF DESCRIPTION OF INVENTION

By one aspect of this invention there is provided a portable and foldable shelter comprising:

- a hinged combination of three substantially rigid pole members, lying in substantially planar parallel relationship when in a folded position, having a hinge member at one end thereof arranged so that two outer pole members may be extended angularly to each other and a central pole member may be extended perpendicularly thereto so as to form a tripod when in an extended position;
- a flexible, planar cover member attached longitudinally along the length of each of said pole members so as to provide a windbreak when in said extended position;
- and ground securing means mounted on a second end of said central pole member.

DETAILED DESCRIPTION OF PREFERRED EMBODIMENTS

Figure 1:
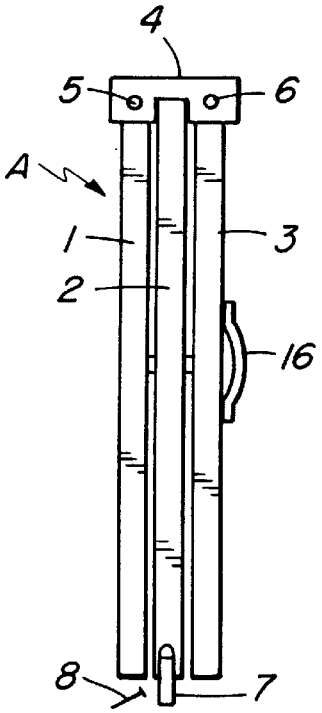
FIG. 1 is a sketch showing a rear view of a shelter frame according to one embodiment of the present invention, in t he folded position.

In FIG. 1 there is shown a metal frame A which comprises three tubular or solid pole members 1,2,3, lying in substantially planar parallel relationship, hingedly interconnected at one end thereof by a hinge member 4. The pole members may be have any desired cross section such as circular or square. If fabricated in metal, such as aluminum or steel, the pole members are preferably tubular in order to reduce weight. If fabricated in fiberglass, or a substantially rigid, but flexible, plastic material, such as nylon, the pole members are generally solid in cross section. A square cross section tubular steel pole has been found to be particularly suitable. Members 1 and 3 pivot outwardly and away from each other on longitudinal pins 5,6 respectively, and the central member 2 pivots perpendicularly rearwardly on a transverse pin (not shown). Central member 2 is provided, at the other, lower, end thereof with a hinged tang 7 which can be secured to the ground or ice by means of a spike 8. As seen more clearly in FIG. 3, a canvas or thermoplastics material, such as woven polyethylene or polypropylene, cover 9 is secured by studs 10 to the pole members 1,2,3.

Figure 2:
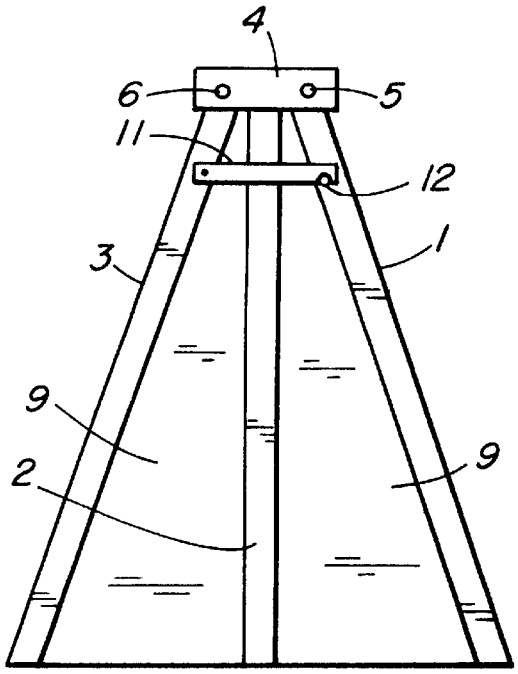
FIG. 2 is a sketch of a front view of the shelter of FIG. 1, in the extended position, including a cover.
Figure 3:
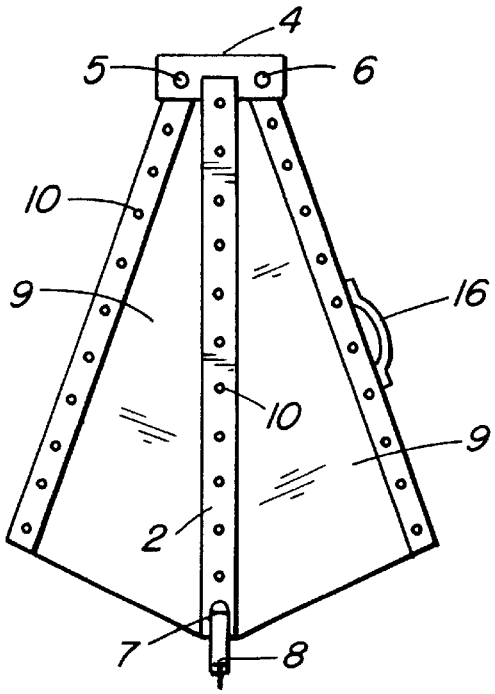
FIG. 3 is a sketch of a rear view of the embodiment of FIG. 2.
Figure 4:
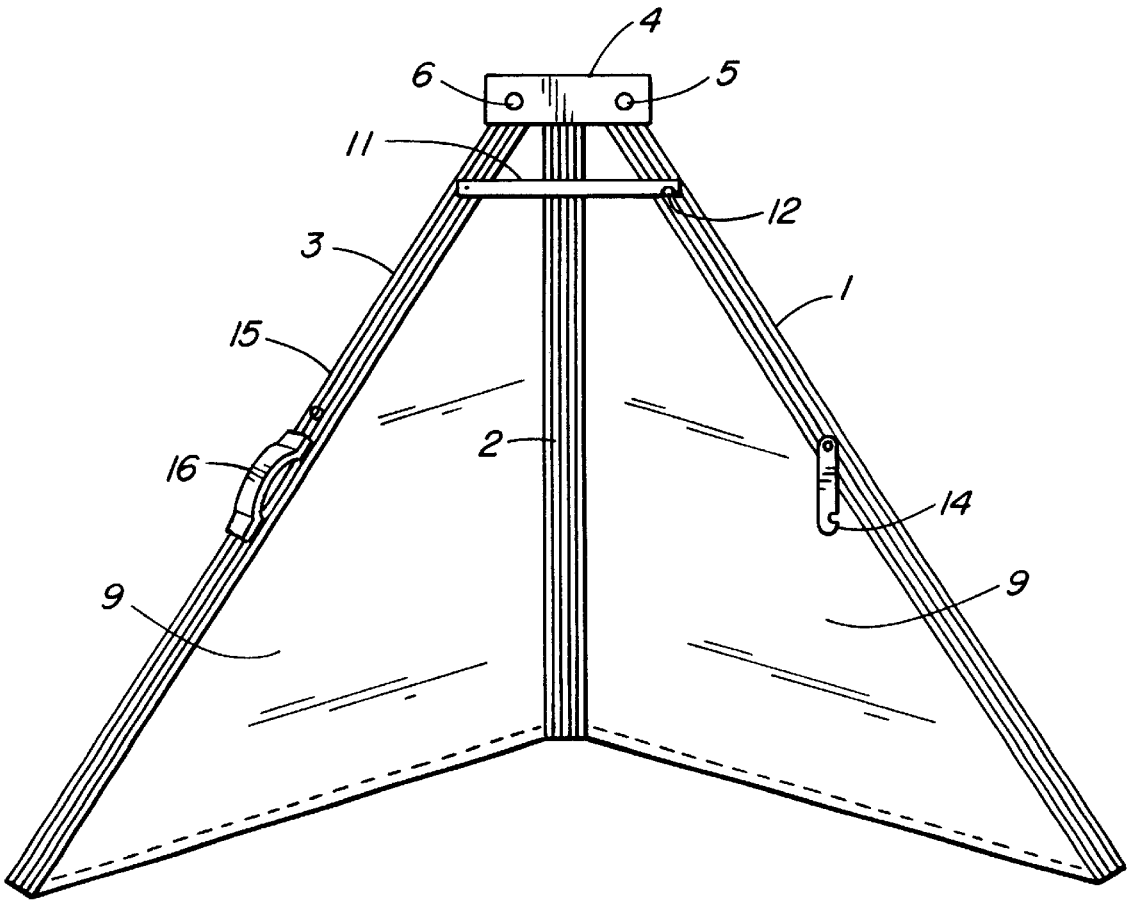
FIG. 4 is a sketch of an enlarged front view of the embodiment of FIG. 2.

In operation the frame A, covered with cover 9 is laid on the ice, with the hinged tang 7 uppermost and pointing directly into the wind, and the spike 8 is hammered into the ice to hold the frame A in place. The erector then lifts the hinge 4 and spreads the pole members 1 and 3 sideways and forwards so as to form a tripod as seen in FIGS. 2, 3 and 4. Preferably, but not essentially, a latch member 11, connected to either of pole member 1,3 adjacent but somewhat spaced from hinge 4, may be provided, which can be releasably secured to the other of pole members 1,3 by pin 12 mounted thereon, so as to releasably secure members 1,3 in the open or extended position. As seen in FIG. 4, pole member 1 or 3 may also be provided with an intermediate latch 14 which can be releasably secured to the other of members 1 and 3 by pin 15 so as to secure pole members 1 and 3 in the closely spaced planar parallel or closed position for ease of transportation, as shown in FIG. 1. A carrying handle 16 may also be provided. Typically, but not essentially, the pole members are about 6 feet long and about 1 inch in diameter. This provides an erected height of about 5'3" with an open width between pole members 1 and 3 of about 6 feet.

The structure described herein is lightweight, relatively inexpensive to manufacture and has been found effective in winds up to at least 35 mph. In the event of a wind shift there is no need to dismantle the shelter. All that needs to be done is to lift the lower ends of poles 1 and 3 from the ice and rotate the erected shelter about spike 8 so that the open side of the shelter again faces directly downwind.

I claim:

1. A portable and foldable shelter consisting of:

- a hinged combination of three substantially rigid pole members, lying in substantially planar parallel relationship when in a folded position, having a hinge member at one end thereof arranged so that two outer pole members may be extended angularly to each other and a central pole member may be extended perpendicularly thereto so as to form a tripod when in an extended position;
- a flexible, planar cover member attached longitudinally along the length of each of said pole members so as to provide a windbreak when in said extended position;
- and ground securing means mounted on a second end of said central pole member.

2. A shelter as claimed in claim 1 wherein said pole members comprise tubular metal members.

3. A shelter as claimed in claim 2 wherein said cover comprises a canvas or thermoplastics material.

4. A shelter as claimed in claim 1 wherein said ground securing means comprises a tang hingedly connected to said central pole member, and a ground engaging spike means.

5. A shelter as claimed in claim 1 including latch means adjacent said hinge member on one of said outer pole members adapted to releasably secure said outer pole members in said extended position.

6. A shelter as claimed in claim 5 including latch means on one of said outer pole members, intermediate the ends thereof, adapted to releasably secure said outer pole members in closed parallel relationship.

7. A shelter as claimed in claim 6 including handle means mounted on one of said outer pole members intermediate the ends thereof.

* * * * *